US005577949A

United States Patent [19]

Matsumoto

[11] Patent Number: 5,577,949

[45] Date of Patent: Nov. 26, 1996

[54] BUFFING METHOD

[75] Inventor: Hiroshi Matsumoto, Hirakata, Japan

[73] Assignee: C. Uyemura & Co., Ltd., Osaka, Japan

[21] Appl. No.: 517,114

[22] Filed: Aug. 21, 1995

Related U.S. Application Data

[63] Continuation of Ser. No. 93,877, Jul. 20, 1993, abandoned.

[51] Int. Cl.[6] ..... B24B 1/00

[52] U.S. Cl. ..... 451/36; 451/41; 451/304

[58] Field of Search ..... 451/28, 36, 41, 451/59, 63, 285, 287, 288, 304, 298

[56] References Cited

U.S. PATENT DOCUMENTS

| | | | |
|---|---|---|---|
| 4,110,083 | 8/1978 | Benedict | 51/295 |
| 4,129,423 | 12/1978 | Rubin | 51/304 |
| 4,235,051 | 11/1980 | Speckman, Jr. | 51/316 |
| 5,142,828 | 9/1992 | Curry, II | 51/281 R |
| 5,316,620 | 5/1994 | Hasegawa et al. | 451/41 |
| 5,355,632 | 10/1994 | Horie | 451/8 |
| 5,387,457 | 2/1995 | Sato | 451/539 |

*Primary Examiner*—James G. Smith
*Assistant Examiner*—Eileen P. Morgan
*Attorney, Agent, or Firm*—Sughrue, Mion, Zinn, Macpeak & Seas

[57] ABSTRACT

A workpiece is buffed to a scratch-free mirror finish by contacting the workpiece against a buff while rotating the buff at about 100 to 1,000 rpm and feeding a buffing compound to the buff. The buffing compound is a slurry containing 3 to 20 wt % of abrasive grains with a mean grain size of up to 2 μm in an aqueous fatty acid soap solution.

8 Claims, No Drawings

BUFFING METHOD

This is a continuation of application Ser. No. 08/093,877 filed Jul. 20, 1993 now abandoned.

BACKGROUND OF THE INVENTION

1. Field of the Invention

This invention relates to a method of buffing a workpiece of nonferrous metals such as aluminum and brass to a scratch-free mirror finish.

2. Prior Art

For articles of nonferrous metals such as aluminum and brass, for example, watch cases, eyeglass frames, table ware, aluminum pans, aluminum door knobs, and automotive aluminum wheel bases, their surface gloss is now of greater importance. It is strongly desired to provide a scratch-free smooth surface in order to meet the decorative requirement as well as the functional requirement.

One typical prior art mirror finish polishing method is a buffing method using a fat bound buffing compound. This method, however, is not fully satisfactory in meeting the demand of a scratch-free smooth surface since abrasive grains introduce mars in the buffed surface.

An electrolytic composite polishing method was proposed in the art to overcome the above-mentioned problem. In polishing a workpiece having a two or three-dimensional curved surface, it was difficult to keep the electrolytic current, voltage and other parameters uniform. The electrolytic composite polishing method was thus limited to the polishing of planar sections. The method also had the problems of complex equipment and an increased polishing cost.

SUMMARY OF THE INVENTION

Therefore, an object of the present invention is to provide a novel and improved method for buffing workpieces of nonferrous metals having varying configurations in a simple manner like the conventional buffing method, to produce a scratch-free mirror finish surface which is never accomplished by the conventional buffing method. Another object of the invention is to provide such a method for buffing a workpiece to a scratch-free mirror finish at a low cost while requiring a simple post-treatment or eliminating the need to wash with organic solvent after buffing.

In order to attain these and other objects, the inventors made investigations on the buffing technique. Buffing is applying a fatty buffing compound to a buff and forcing a workpiece in pressure contact with the buff while rotating the buff at a high speed. In order to minimize scratches caused by abrasive grains, finish buffing uses a fat-based base buffing compound having abrasive grains coated with fat. Abrasive grains are not secured on the buff surface (not bonded abrasive grains), but are allowed to move freely to some extent. Since abrasive grains are coated with fat, smoothing and mirror finishing are accomplished by the cutting of the abrasive grains themselves assisted by lubricating forces of the fat and, the reaction of the fat with the metal of the workpiece to form a metal soap, especially at high temperatures and high pressure. The action exerted on the workpiece varies depending one the properties, size and composition of the abrasive grains. In general, as the abrasive grains become larger or harder, greater abrasiveness is exerted and deeper grinding streaks are left. Finish buffing for producing a mirror finish surface conventionally uses abrasive grains of up to 1 μm of iron oxide, chromium oxide and alumina or very low hardness abrasive grains of calcium carbonate and amorphous silica. However, it is impossible to eliminate scratches and mars by abrasive grains insofar as buffing at a high temperature and high pressure. In an experimental attempt to prepare a buffing compound from fat without adding abrasive grains thereto and buff a workpiece With a buff wheel using the compound, the inventors found that the workpiece is scratched due to contact with the buff. This suggests that no scratch-free surfaces can not be produced by the conventional buffing method. Nevertheless, the buffing has many advantages in that it is a simple mechanism, follows curved surfaces well and is low in machine cost. Continuing further investigations on the buffing technique, the inventors have found that a scratch-free mirror finish surface can be developed by carrying out buffing while feeding the buff a slurry Of abrasive grains having a mean grain size of up to 2 μm, especially up to 1 μm dispersed in an aqueous fatty acid soap solution in a concentration of 3 to 20% by weight.

Workpieces as finally finished by a conventional buffing technique have a maximum surface roughness Rmax of about 0.1 μm. This is the best roughness achievable by the conventional buffing technique, but scratches and mars by abrasive grains are visually observable on the surface under a fluorescent lamp or sunlight. In contrast, the buffing method of the present invention provides a workpiece with a maximum surface roughness Rmax of significantly lower than 0.1 μm. On a surface with Rmax of lower than 0.1 μm, scratches and mars by abrasive grains are no longer visually observable under a fluorescent lamp or sunlight. Accordingly, the inventive method can produce a scratch-free glossy surface which is definitely distinguishable in outer appearance over the surfaces achieved by the conventional buffing techniques.

The reason is described below. The conventional buffing mechanism involves the overall interactions among fat, abrasive grains and buff at high a temperature and pressure including the reaction of a fatty acid with metal and cutting by abrasives grains as previously mentioned. Deep scratches are often formed since abrasive grains exert considerable cutting action. In addition, it is presumed that an oxidation reaction also occurs at the workpiece surface since the buffing compound contains fatty acid. As a result, scratches by grains in a surface oxide film can appear as deeply scraped off streaks.

In contrast, the inventive method carries out buffing without using fat while rotating the buff, preferably at a moderate circumferential speed of up to 1,000 m/min. at which an excessively high temperature and pressure are not developed. The abrasive grains in the slurry take over the grinding action while the fatty acid soap in the slurry exerts lubricating forces to prevent excessive cutting by the grains. Consequently, buffing is accomplished to a scratch-free mirror finish.

It is to be noted that conventional fatty buffing compounds include pastes known as liquid buffing compounds, which are obtained by emulsifying a solid buffing compound in water with the aid of an emulsifying agent to form an emulsified paste. Using a spray gun, the paste is fed to a buff where the paste plays the role of a solid buffing compound after water evaporates off due to abrasion heat. Buffing is followed by the same post-treatment as required for the solid buffing compound. In this regard, the inventive method is distinguishable over the use of liquid buffing compounds or pastes.

Accordingly, the present invention provides a method for buffing a nonferrous metal workpiece by forcing the workpiece against a buffing compound-bearing buff while rotating the buff, thereby abrading the workpiece on a surface. The buffing compound is a slurry of abrasive grains having a mean grain size of up to 2 μm dispersed in an aqueous fatty acid soap solution in a concentration of 3 to 20% by weight.

DETAILED DESCRIPTION OF THE INVENTION

The polishing method of the present invention is directed to a buffing method which is advantageously used in buffing a surface of nonferrous metal such as aluminum and brass to a mirror finish as a final finish. In this regard, the method of the invention preferably starts with a workpiece to be buffed which has been worked to a maximum surface roughness Rmax of up to 0.5 μm.

Any desired conventional techniques may be used to grind or process the workpiece to a maximum surface roughness Rmax of up to 0.5 μm. For example, workpieces can be finished to Rmax of up to 0.5 μm by sequentially carrying out emery abrasion, medium buffing using a sisal buff, and medium finishing using a cotton buff.

The workpiece once finished in this way is subjected to buffing according to the present invention. The buffing compound which is fed and applied to the buff is a slurry of abrasive grains having a mean grain size of up to 2 μm, preferably up to 1 μm dispersed in an aqueous fatty acid soap solution.

The abrasive grains used herein include grains of alumina, chromium oxide, iron oxide, fused calcined alumina, silicon carbide, zirconia, silicon nitride, and silica alone or in admixture of two or more. The grains have a mean grain size of up to 2 μm, preferably 0.3 to 1 μm. It is preferred for scratch prevention to exclude those grains having a size of more than 2 μm. The slurry contains 3 to 20%, preferably 3 to 10% by weight of the abrasive grains.

The slurry contains a fatty acid soap, preferably in an amount of 1 to 20%, more preferably 3 to 10% by weight. With less content of the fatty acid soap, there would be insufficient interfacial lubricating between the grains and the workpiece. Too much of the fatty acid soap would detract from abrasiveness or grinding force, failing to fully smooth the workpiece.

Examples of the fatty acid soap include salts of alkali metals such as sodium and potassium with saturated and unsaturated fatty acids preferably having 8 to 18 carbon atoms such as caprylic acid, capric acid, lauric acid, myristic acid, palmitic acid, stearic acid, and oleic acid, and mono-, di- and triethanol amine salts of such fatty acids, alone and in admixture of two or more.

Preferably a surfactant is blended in the aqueous solution. The triethanol amine salts mentioned just above themselves are useful surfactants while nonionic surfactants such as polyoxyethylene lauryl ether and sorbitan monooleate are preferred. In addition, there can be added agents for improving re-dispersion of abrasive grains such as celluloses, and foam controlling agents such as polyalkylene glycols. The amount of the surfactant, re-dispersing agent and foam controlling agent added may be about 1 to 3% by weight.

The buff to which the slurry is applied is formed of a material which is preferably fully hygroscopic in order to ensure that the buff retains the slurry, for example, hygroscopic fibers such as felt, flannel, and spongy synthetic fibers. The size of the buff may be properly selected in accordance with the workpiece to be buffed although it generally has a diameter of 10 to 300 mm. The slurry is fed to the buff by gravity drip, spraying, and pumping.

In the practice of the invention, a workpiece is buffed in a conventional buffing manner although the rotational speed of the buff is preferably set low. The buff wheel is rotated at about 1,500 to 2,500 rpm in the conventional final finish buffing technique using a conventional green rouge or the like whereas the present invention favors to rotate the buff at 100 to 1,000 rpm and at a circumferential speed of up to 1,000 m/min. Beyond the upper limit of revolution per minute or circumferential speed, the slurry or buffing compound would be scattered away and a larger quantity of the buffing compound must be fed.

Typically, about 1 to 10 ml of the slurry is fed to the buff for a single buffing procedure. The buffing time is generally about 10 to 30 seconds.

In the practice of the invention, the slurry is stored in a tank and fed therefrom to the buff by a suitable feed means as mentioned above. The buff receives and is impregnated with the slurry. An excess of the slurry leaving the buff, if any, may be recovered and recycled to the tank for reuse.

After buffing, the workpiece is cleaned. In the conventional buffing technique using a fat-bound buffing compound, the workpiece must be cleaned with organic solvents such as trichloroethylene. Since the method of the invention does not use fat and oil at all, the workpiece after buffing may be cleaned simply by the steps of water washing, hot water washing and drying. The invention eliminates the use of hazardous organic solvents for cleaning.

EXAMPLE

Examples of the present invention are given below by way of illustration and not by way of limitation.

Example

The workpiece used was an aluminum door knob. It was ground with a #250 emery buff to a maximum surface roughness of 1.3 μm and then finished by rotating a bias buff of 12 inches in diameter at 2,300 rpm and using fat-bound buffing compound, U Lime (manufactured by C. Uyemura & Co., Ltd.: the main fatty acid is stearic acid and the abrasive grain is alumina having a mean grain size of 10 μm). The maximum surface roughness was 0.4 μm.

Thereafter, the workpiece which had been finished with U Lime was buffed by rotating a felt buff having a diameter of 150 mm at 400 rpm and a circumferential speed of 188.4 m/min. and spraying a slurry of the following composition to the buff by means of a spray gun. The workpiece was forced against the rotating buff for buffing. For a single buffing procedure, the amount of the slurry sprayed was 4 ml and the buffing time was 10 seconds. After buffing, the workpiece was washed with a neutral detergent, rinsed with hot water, and dried.

Slurry composition

| | |
|---|---|
| Fatty acid soap* | 10% by weight |
| Alumina** | 20% by weight |
| Surfactant*** | 2% by weight |
| Water | Balance |
| Total | 100% |

*a mixture of 65% sodium stearate and 35% sodium palmitate
**calcined alumina having a mean grain size of 0.8 μm
***polyoxyethylene nonyl phenyl ether (HLB 18.2)

COMPARATIVE EXAMPLE

An aluminum door knob was ground with a #250 emery buff to a maximum surface roughness of 1.3 μm and then finished by rotating a bias buff of 12 inches in diameter at 2,300 rpm and using fat-bound buffing compound, U Lime (manufactured by C. Uyemura & Co., Ltd.). Thereafter, the knob was finally finished with buff of the same shape as above using a gloss finish #3000 green rough (manufactured by C. Uyemura & Co., Ltd.: the main fatty acid is stearic acid and the abrasive grain is the mixture of chromium oxide and alumina having a mean grain size of 2.0 μm). The amount of green rough used per single buffing was 5 grams and the buffing time was 10 seconds. After buffing, the workpiece was washed with trichloroethylene and dried.

The workpieces (door knobs) buffed in Example and Comparative Example were measured for surface roughness at four points using Surfcom Model 1500 (manufactured by Tokyo Seimitsu K. K.). Measuring conditions included a magnifying power of 50,000, a measurement distance of 2 mm, and a cutoff of 0.08. The results are shown in Table 1 as an average of four measurements.

TABLE 1

| | Ra | Rt | RzD | RMS | Rmax | Rz |
|---|---|---|---|---|---|---|
| Comparative Example | 0.006 | 0.12 | 0.071 | 0.008 | 0.18 | 0.089 |
| Example | 0.002 | 0.07 | 0.021 | 0.003 | 0.07 | 0.044 |

In Table 1,
Ra: Arithmetic Average, Center Line Average Height
Rt: Maximum Height, Maximum Peak - Vally Roughness
Rz.D: Ten points height of irregularities (DIN)
RMS: Root Mean Square Average
Rmax: Maximum Height, (JIS) Maximum Peak - Valley Roughness
Rz: Ten points height of irregularities (ISO)

As is evident from Table 1, the workpiece buffed by the inventive method had a maximum surface roughness Rmax which is less than one-half of Comparative Example and appeared highly lustrous when its outer appearance was inspected by visual observation under a fluorescent lamp and sunlight. In contrast, the comparative workpiece had visually observable grinding streaks, appeared while lustrous and was significantly inferior to the inventive work-piece.

There has been described a method of buffing a workpiece to a scratch-free, mirror finish surface having high glossiness. Eliminating the use of fat and oil in the buffing compound, the inventive method simplifies post treatment in that no contaminants are left on the buffed surface and washing the surface with organic solvents such as trichloroethylene can be omitted. Although recycling of the buffing compound was impossible in the conventional buffing techniques, the inventive method enables the buffing compound to be recycled offering the advantages of material savings and minimized environmental pollution.

I claim:

1. A method for buffing a nonferrous metal workpiece to a scratch-free mirror finish comprising the steps of:

forcing the workpiece against a buffing compound-bearing buff while rotating the buff from 100 to 1,000 rpm at a circumferential speed of up to 1,000 m/min, and abrading the workpiece until a surface of the workpiece has a maximum surface roughness, Rmax, of less than 0.1 μm, wherein said buffing compound is a slurry of abrasive grains in a concentration of 3 to 20% by weight and having a mean grain size of 0.3 to 2 μm dispersed in an aqueous fatty acid soap solution which has a concentration of 1 to 20% by weight fatty acid soap.

2. The method of claim 1 wherein the abrasive grains have a mean grain size of 0.3 to 1 μm.

3. The method of claim 1 wherein the abrasive grains are selected from the group consisting of calcined alumina, chromium oxide, iron oxide, fused alumina, silicon carbide, zirconia, silicon nitride, and silica.

4. The method of claim 1 wherein the fatty acid soap is selected from the group consisting of alkali metal salts of saturated and unsaturated fatty acids having 8 to 18 carbon atoms and mono-, di- and triethanol amine salts of saturated and unsaturated fatty acids having 8 to 18 carbon atoms.

5. The method of claim 1 wherein the workpiece is made of aluminum or brass.

6. The method of claim 1 wherein the concentration of abrasive grains is from 3 to 10% by weight.

7. The method of claim 1 wherein the concentration of fatty acid soap is from 3 to 10% by weight.

8. The method of claim 1 wherein the slurry further comprises at least one of a surfactant, a re-dispersing agent or a foam controlling agent.

* * * * *